US006330721B1

(12) United States Patent
Wallace et al.

(10) Patent No.: US 6,330,721 B1
(45) Date of Patent: Dec. 18, 2001

(54) SHOWER CAP WITH ELASTIC STRAP SUSPENSION DEVICE

(76) Inventors: Deborah Wallace, 67 Underwood Pl., Washington, DC (US) 20012; Matilda Y. Parker, 628 Kennebec Ave., Takoma Park, MD (US) 20912

( * ) Notice: Subject to any disclaimer, the term of this patent is extended or adjusted under 35 U.S.C. 154(b) by 0 days.

(21) Appl. No.: 09/528,429

(22) Filed: Mar. 17, 2000

Related U.S. Application Data

(60) Provisional application No. 60/124,815, filed on Mar. 17, 1999.

(51) Int. Cl.[7] ..... A42B 1/18
(52) U.S. Cl. ..... 2/174; 2/67
(58) Field of Search ..... 2/171, 174, 204, 2/67, 68, 202

(56) References Cited

U.S. PATENT DOCUMENTS

| | | | | |
|---|---|---|---|---|
| D. 323,241 | * | 1/1992 | Neal | D2/510 |
| 361,577 | * | 4/1887 | Culver . | |
| 366,477 | * | 7/1887 | Guiley . | |
| 770,338 | * | 9/1904 | Tooher | 2/68 |
| 1,345,547 | * | 7/1920 | McDonald . | |
| 2,240,407 | * | 4/1941 | Masters | 272/57 |
| 2,515,959 | * | 7/1950 | Johnson | 2/68 |
| 2,726,398 | * | 12/1955 | Cooper | 2/68 |
| 3,051,960 | * | 9/1962 | Rendulich | 2/68 |
| 3,714,670 | * | 2/1973 | Pollack et al. | 2/197 |
| 4,400,830 | * | 8/1983 | Gaitan | 2/68 |
| 4,683,596 | * | 8/1987 | Cole | 2/68 |
| 5,203,358 | * | 4/1993 | Eytcheson | 132/212 |
| 5,524,650 | * | 6/1996 | Ponce | 132/270 |
| 5,773,802 | * | 6/1998 | Graves | 219/759 |
| 5,842,231 | * | 12/1998 | Dawes | 2/202 |
| 5,890,229 | * | 4/1999 | Esposito | 2/174 |

* cited by examiner

*Primary Examiner*—John J. Calvert
*Assistant Examiner*—Katherine Moran

(57) ABSTRACT

A shower cap comprising an elastic strap (14) that is permanently attached to the elastic band (11) located at lower edge (16) of a shower cap. The elastic strap has fasteners **(12 & 12*a*)** on each end that allow it to form a loop and suspend from a shower curtain rod, towel rack, doorknob, or hook/nail in the wall. This suspension also allows the shower cap to thoroughly dry. The elastic strap permits convenient storage of the shower cap and that helps to eliminate the possibility of it being misplaced. The fasteners on each end of the elastic strap can be easily pulled apart and reattached because they are in the form of hook and loop fasteners (VELCRO tabs).

7 Claims, 10 Drawing Sheets

SHOWER CAP WITH ELASTIC STRAP SUSPENSION DEVICE

CROSS-REFERENCE TO RELATED APPLICATIONS

This application is entitled to the benefit of Provisional Patent Application Ser. No. 60/124,815, filed Mar. 17, 1999.

BACKGROUND—FIELD OF INVENTION

This invention relates broadly to a shower cap, but more particularly to a novel suspension device for a shower cap whereby the shower cap may be conveniently stored on a towel rack, shower curtain rod, doorknob, or hook/nail in the wall and dried after use.

BACKGROUND—DESCRIPTION OF PRIOR ART

Consumers worldwide commonly use shower caps to protect the hair while bathing or showering. Such shower caps are sold to consumers in grocery stores, drug stores, convenient stores, beauty supply stores, and mail-order catalogs.

Shower caps were never made with any means of convenient suspension or storage. The common complaint of most consumers is that after use, there is no convenient way or a convenient place to store the shower cap. Some complain of not being able to locate the shower cap when it is time to use it because it is not always stored in the same place. If it is placed on the doorknob it often falls to the floor; if placed on the shower head it usually gets wet before its use; if placed on a dresser or table top it will leave water stains.

Although there have been attempts to solve this problem, it still exists today. U.S. Pat. No. 3,051,960 to Rendulich (1959) discloses a complex and bulky suspension device that can be attached to the shower cap to allow for suspension and storage; however, this device requires that the shower cap's crest be strengthened by a reinforcing patch. The device is also made from rubber and is heavier in weight than contemporary shower caps. The requirement of a reinforced patch renders this suspension device comparatively non-economical to manufacture. Also, many items today are made in a more lightweight and compact manner. Although this patent came closest to the subject matter, its complicated features fail to solve the problem in an efficient and economical way. The major disadvantage of the shower cap suspension device heretofore mentioned is:

(a) The requirements of a reinforcing patch at the crest of the crown is not economical in its manufacture.

(b) The suspension device is made from rubber and is heavier in weight than contemporary shower caps.

Other types of suspension devices have been proposed—for example U.S. Pat. No. 366,477 to Guiley (1887), U.S. Pat. No. 361,577 to Culver (1887), U.S. Pat. No. 1,345,547 to McDonald (1920), U.S. Pat. No. 2,240,407 to Masters (1941), and U.S. Pat. No. 2,515,959 to Johnson (1950). These patents include a hat hook, hat holder, woman's hat with a holder, exercising headpiece apparatus, and a shower bath helmet respectively. None of these patents suggest the novel features of this present invention.

SUMMARY

In accordance with the present invention a shower cap with an elastic strap suspension device comprises a shower cap, an elastic band, a hook-and-loop fastener, and an elastic strap.

OBJECTS AND ADVANTAGES

Accordingly, several objects and advantages of the invention are:

(a) to provide a convenient way to store and dry a shower cap when it is not in use;

(b) to provide easier access to a shower cap from its storage place;

(c) to provide an opportunity to not misplace a shower cap after its use;

(d) to provide a variety of convenient storage places for a shower cap which will allow the cap to dry thoroughly.

Further objects and advantages are to provide a shower cap with a means of suspension that can be used easily, without damage to the shower cap, which is simple to make and inexpensive to manufacture.

DRAWING FIGURES

REFERENCE NUMERALS IN DRAWINGS

10 crown
11 elastic band
12 hook-and-loop fastener (loop surface)
12*a* hook-and-loop fastener (hook surface)
13 stitches (attached end of strap)
13*a* stitches (unattached end of strap)
14 elastic strap
16 lower edge
18 snap buttons

DESCRIPTION—FIG. 1 PREFERRED EMBODIMENT

Figure 1:
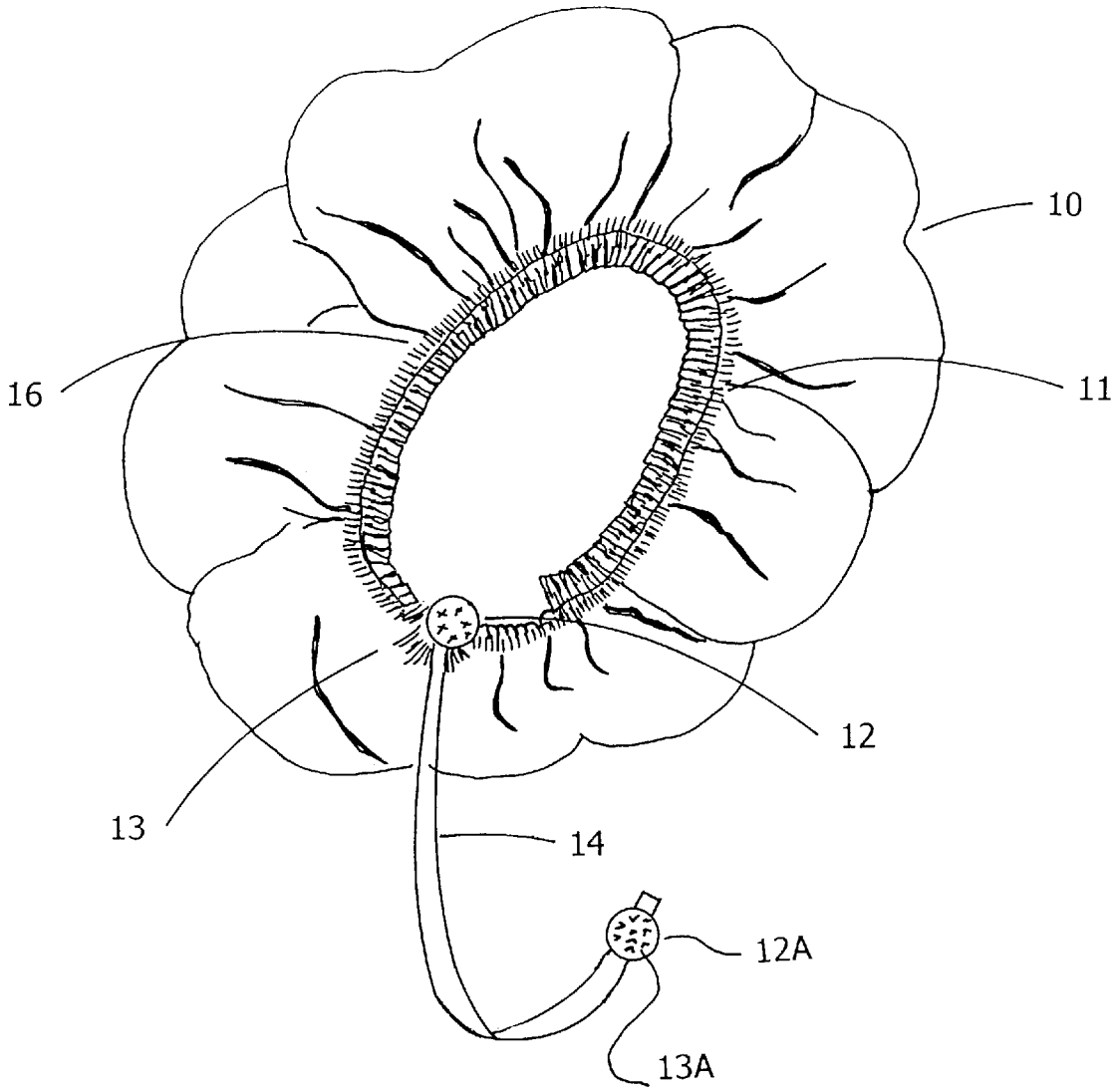
FIG. 1 is a perspective view of a shower cap embodying an opened elastic strap suspension device.

A preferred embodiment of a shower cap with an elastic strap suspension device is illustrated in FIG. 1 (perspective view). The shower cap may be constructed of any suitable waterproof material but preferably plastic. The crown 10 which forms the head opening is provided with an elastic band 11 sewn around lower edge (16) of shower cap. The elastic band gathers the material for the obvious purpose of drawing the shower cap against the head of the user.

The elastic strap suspension device is comprised of three parts as illustrated in FIG. 1. These parts are an elastic strap 14 and a hook-and-loop fastener 12 and 12*a*. It is compact, flexible and lightweight. While in use, it may be tucked under the shower cap without any discomfort to the user.

Elastic strap 14 is preferably made of a thin strap of elastic typically ¼ inch in width. It is best if it is the same size (in width) as elastic band 11 because it will be less apparent, thus, neater looking. It will also be streamline enough to hang from a hook/nail in the wall if so desired by the user, however, most any reasonable size (in width) elastic strap may be used. Elastic strap 14 must also be of substantial length so that it may be suspended from a doorknob, towel rack or shower curtain rod. Typically the measurement is 9½ inches in length.

Elastic strap 14 with hook-and-loop fastener on each end 12 & 12*a* is sewn onto elastic band 11 by means of stitches in its center as at 13 (FIG. 1).

In practice, an end of elastic strap 14 is placed over a section of elastic band 11 which is sewn onto lower edge 16 of shower cap. Next, one of the tabs of hook-and-loop fastener 12 is placed over both a section of elastic band 11 and an end of elastic strap 14. At this point all three, a section of elastic band 11, an end of elastic strap 14, and one of the tabs of hook-and-loop fastener 12 are all sewn together as at 13 (FIG. 1). It is to be noted that it does not make a difference whether loop end 12 or hook end 12*a* is used at 13 as long as one of each is sewn onto each end of elastic strap 14. The remaining tab of hook-and-loop fastener 12*a* is sewn onto the unattached end of elastic strap 14 by means of stitches as at 13*a*. When the ends of elastic strap 14 are joined together by means of the hook-and-loop fastener 12 and 12*a*, a loop is formed.

A quicker means of doing this is having the manufacturer of a shower cap extend the length of elastic band 11. This extended band will replace elastic strap 14 so that only hook-and-loop fastener 12 & 12*a* need to be sewn onto the extended band. This eliminates the step of sewing elastic strap 14 onto elastic band 11.

Without such a suspension device, it is impossible to conveniently store the shower cap when it is not in use. It is also impossible to conveniently dry the shower cap after use. It is to be noted that elastic strap suspension device 12, 12*a*, & 14 is to be a permanent attachment to a shower cap made by the manufacturer and not sold as a separate entity to be later attached to a shower cap.

Additional Embodiments

In additional embodiments the suspension device fastens to the opposite side (left side to right side) of the shower cap; or the suspension device extends from both sides of the shower cap and fastens at its end points.

Figure 2:
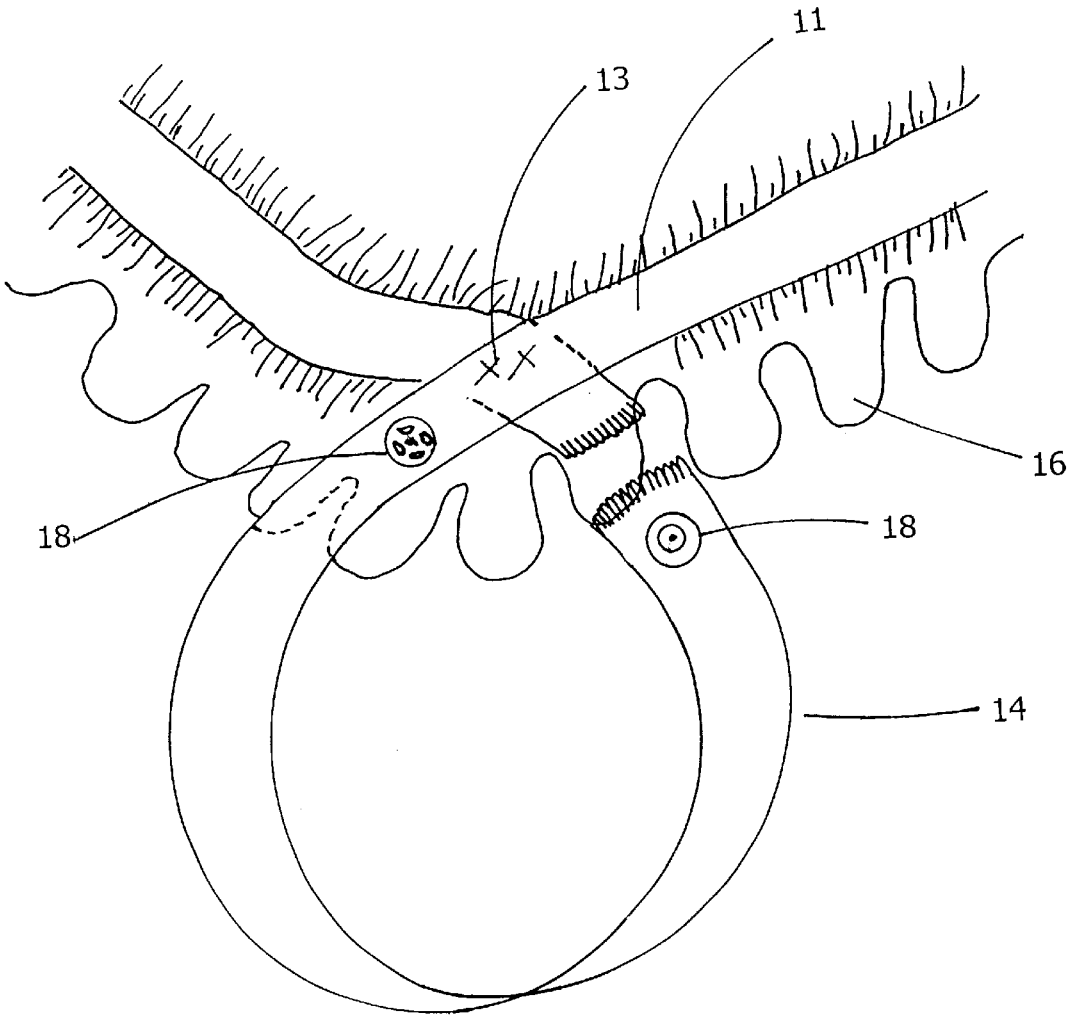
FIG. 2 is a perspective view of an elastic strap suspension device with snap buttons as fasteners.
Figure 3:
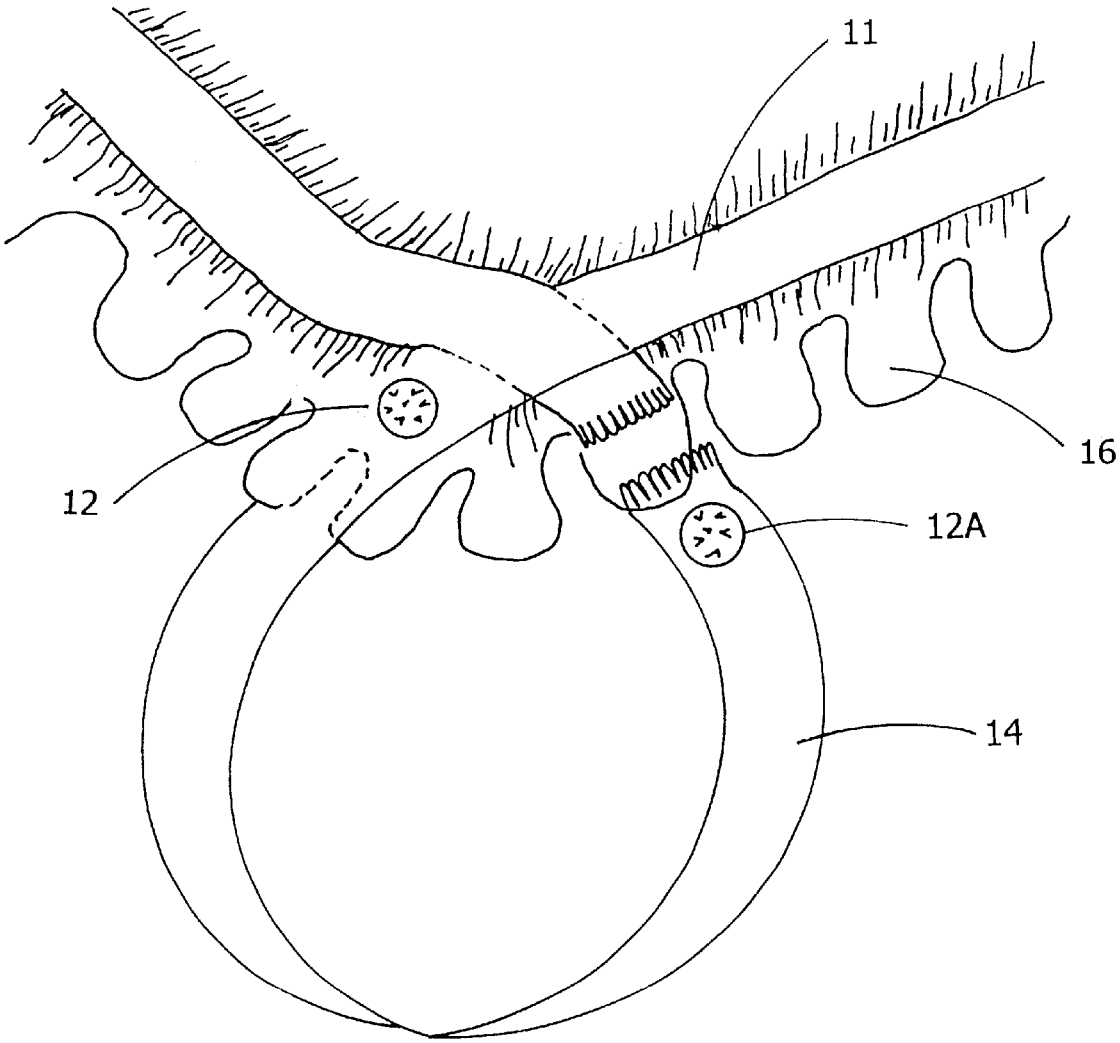
FIG. 3 is a perspective view of an elastic band extending beyond and out of lower edge of a shower cap to form a loop.
Figure 4:
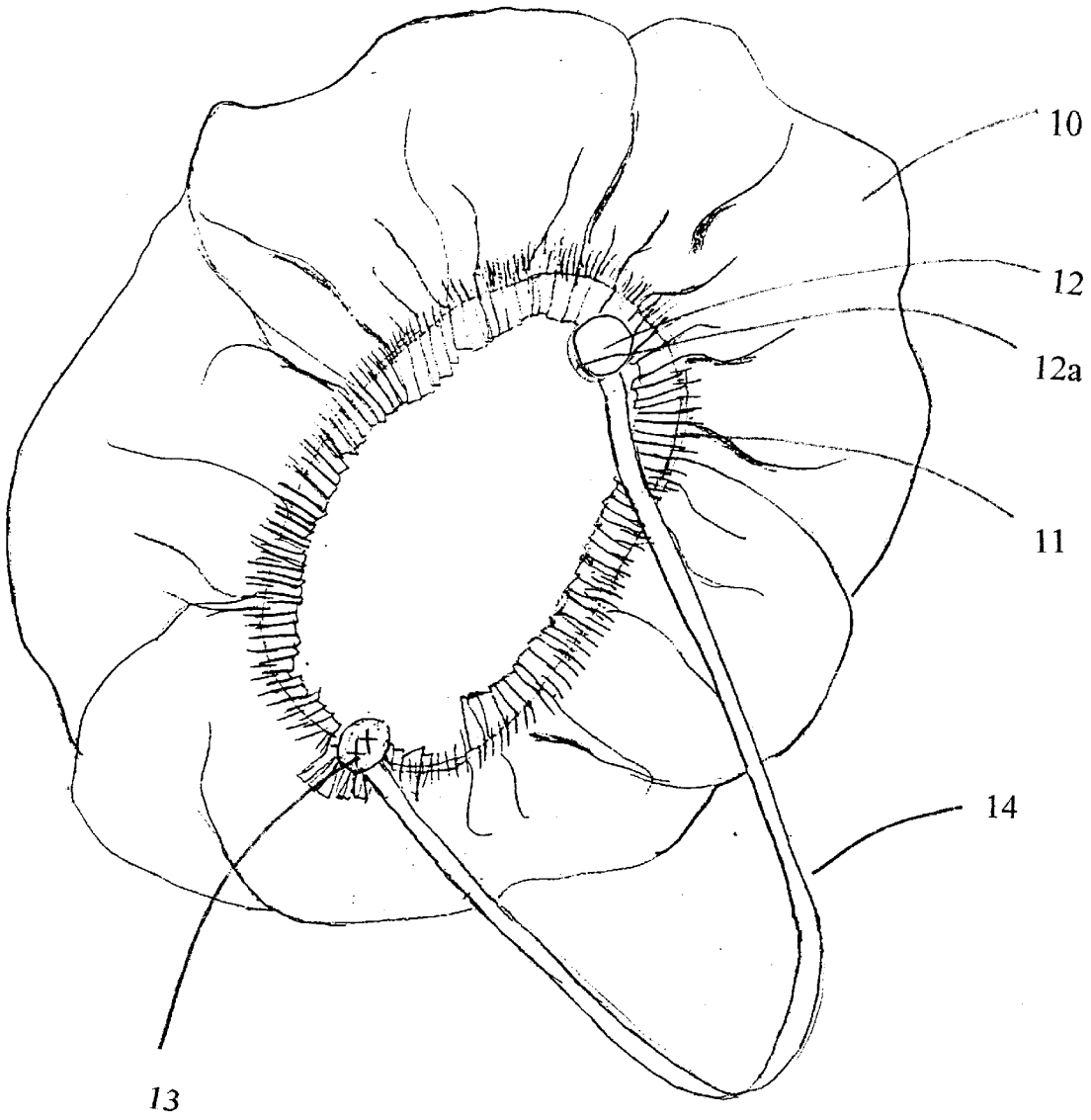
Figure 5:
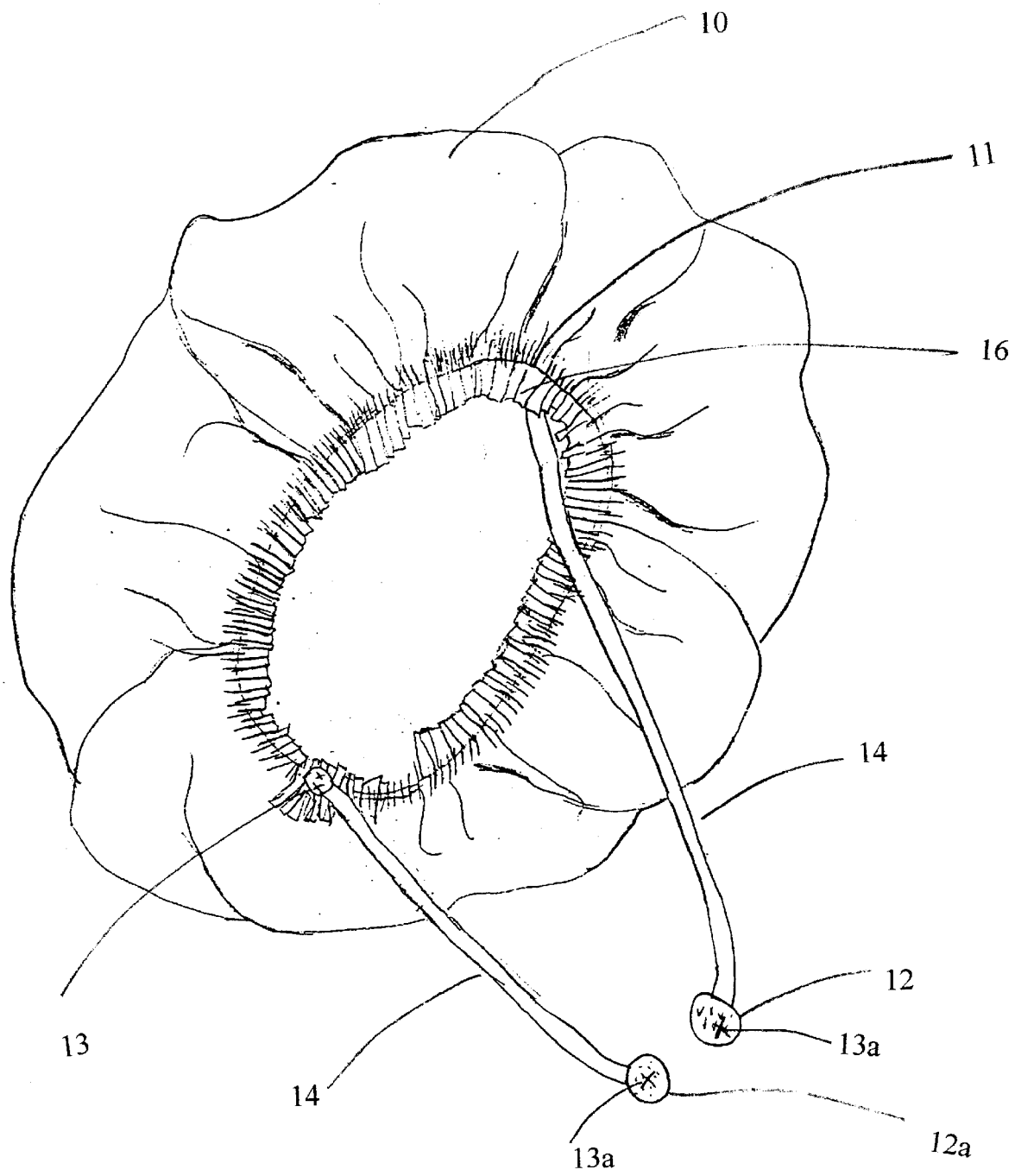
Figure 6:
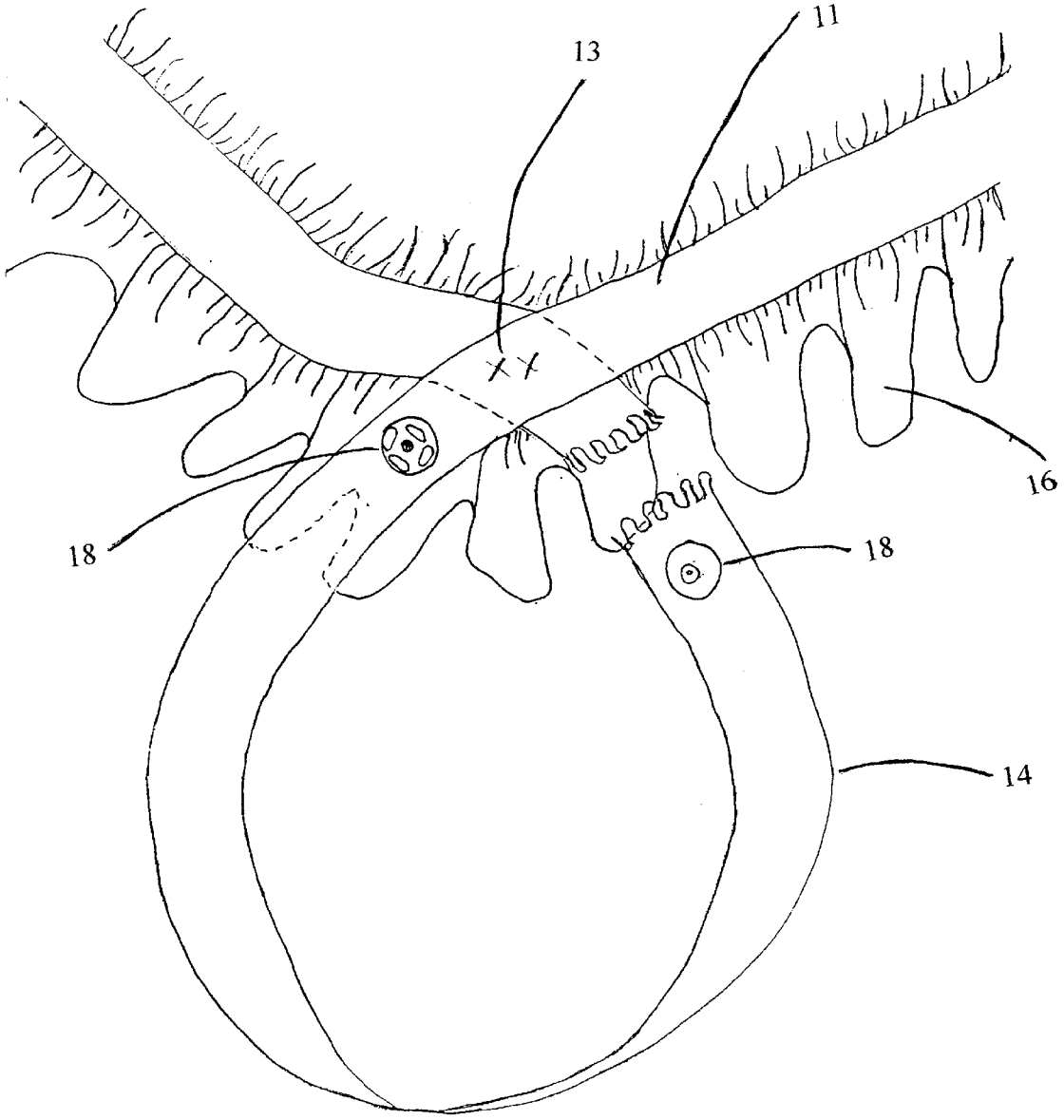
Figure 6A:
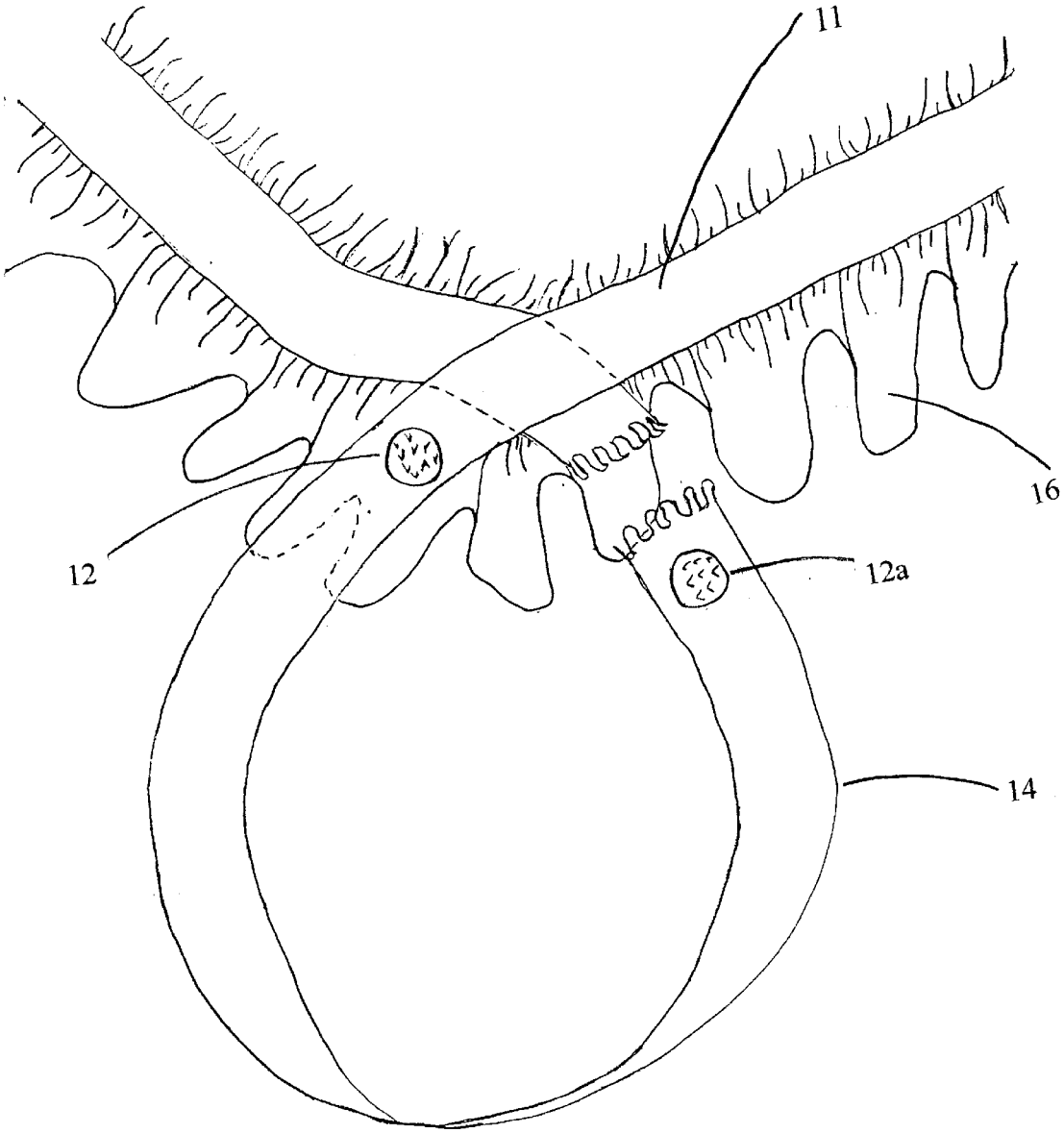
Figure 7:
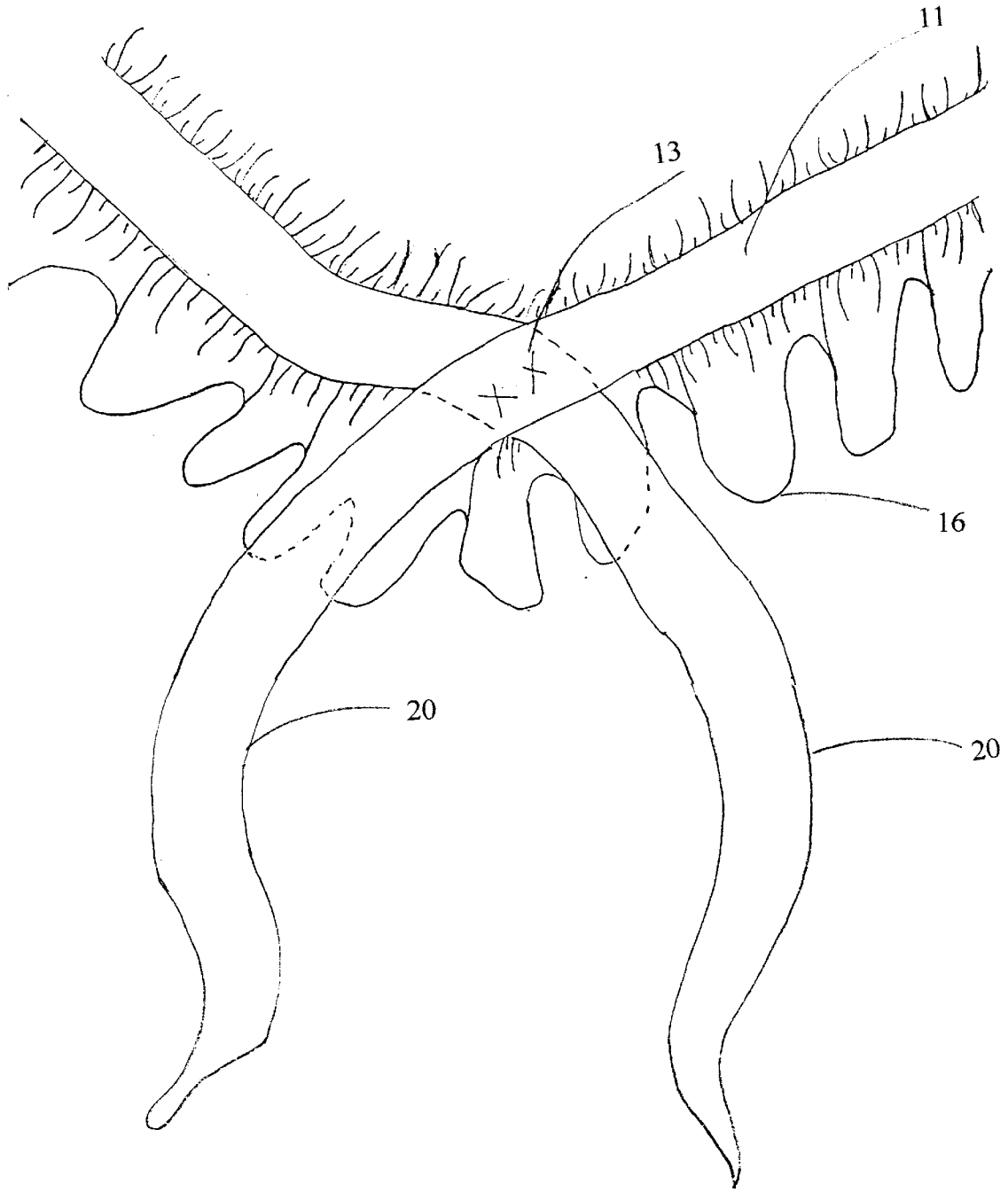
Figure 7A:
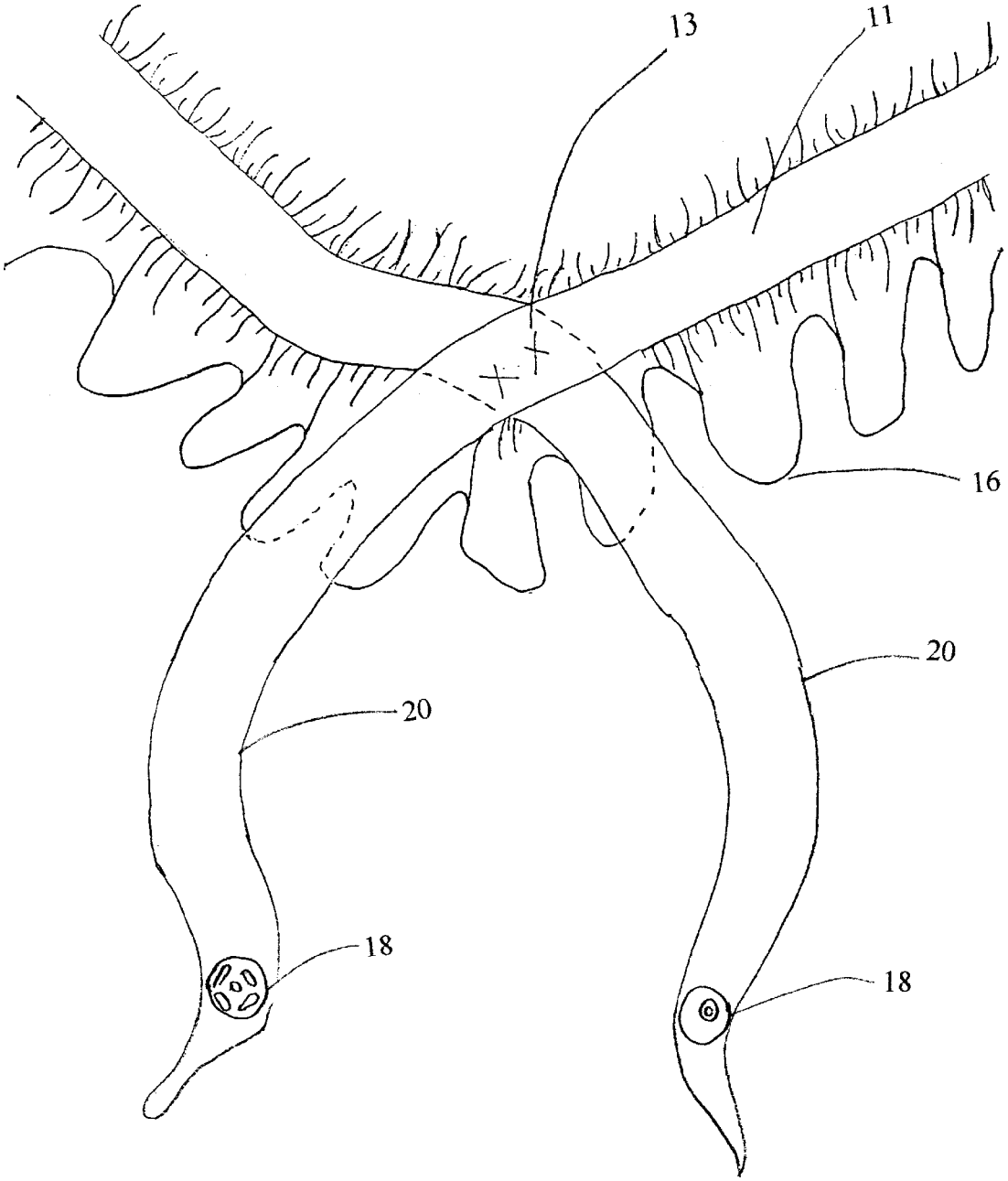
Figure 8:
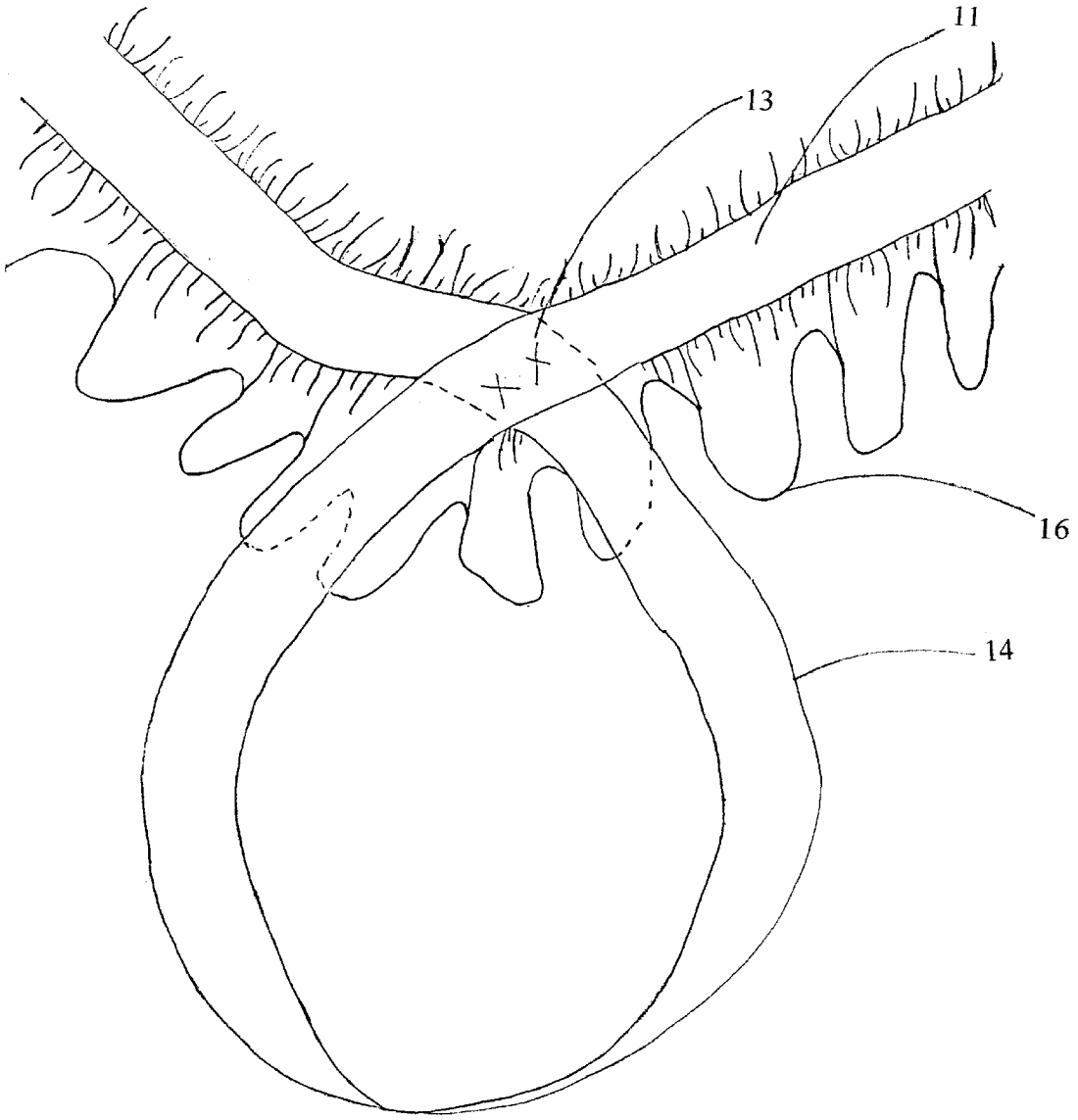

FIG. 2 Alternative Embodiment

There are various possibilities with regard to the type of fasteners that are attached to the suspension device. An alternative embodiment is shown in FIG. 2. In this case only the fasteners, elastic strap, and elastic band are shown. In FIG. 2 fastener (18) is snapped together; it could be tied together by a ribbon or string, snapped together at ends of ribbon or string; be without a fastener but permanently attached to the shower cap to form a loop.

Although the preferred embodiment is a shower cap with an elastic strap suspension device, the suspension device may be used to suspend other objects such as hats, mittens, umbrellas, etc. However, as stated above, the preferred embodiment is an elastic strap suspension device permanently attached to a shower cap.

ADVANTAGES

From the description above, a number of advantages of my shower cap with elastic strap suspension device become evident:

(a) The structure of the present invention allows it to be manufactured almost by the same process that shower caps have always been made with two small variations; extending elastic band 11 and attaching hook-and-loop fasteners 12 and 12*a*, thus keeping production cost down.

(b) With the use of hook-and-loop fasteners 12 and 12*a* on elastic strap 14, as opposed to previously sited alternative embodiments (FIG. 2), attaching and detaching the strap from a shower rod becomes virtually effortless.

(c) The shower cap with elastic strap suspension device allows for a variety of convenient storage places, thus, eliminating the problem of misplacing it.

(d) The present invention allows the shower cap to suspend from a shower curtain rod, hook/nail in the wall, and doorknob, etc., thus providing a better way for drying thoroughly without causing water stains on furniture or other undesirable places. This provides a benefit that a shower cap that is without a suspension device would not have.

Operation—FIG. 1

The manner of using elastic strap suspension device 12, 12*a*, & 14 is quick, easy, and effective when storing and drying a shower cap after its use. Namely, when the shower cap is in use, elastic strap suspension device 12, 12*a*, & 14 is comfortably tucked under the shower cap while on the user's head. For storage and drying after use, one first pulls tabs of hook-and-loop fastener 12 & 12*a* apart so that elastic strap suspension device 12, 12*a*, & 14 is in an opened position as shown in FIG. 1. Next, holding opened elastic strap suspension device 12, 12*a*, & 14 adjacent to a curtain rod or towel rack, one folds elastic strap 14 over the rod or rack and presses tabs of hook-and-loop fastener 12 & 12*a* back together, forming a closed position. At this time, the shower cap is conveniently suspended from a shower curtain rod or towel rack.

To remove the shower cap from a shower curtain rod or a towel rack, one pulls tabs of hook-and-loop fastener 12 & 12*a* apart. This releases the hold and the shower cap may be pulled off or it will naturally drop.

For storage and drying from a doorknob or hook/nail in the wall, simply keep tabs of hook-and-loop fastener 12 & 12*a* pressed together to form a loop and hang from the doorknob or nail. To remove, simply lift from doorknob or nail.

Conclusion, Ramifications, and Scope

Accordingly, the reader will see that the suspension device of the shower cap invention provides a practical and convenient means of storing and drying the shower cap while at the same time eliminating misplacing it. In addition, when storing the shower cap on the most practical apparatus, that being a towel rack or shower curtain rod, the user will not have to be concerned about water stains in undesirable areas or on undesirable places such as dresser and table tops. Furthermore, the shower cap with the elastic strap suspension device has additional advantages in that It provides a variety of convenient storage places for a shower cap which will allow the cap to dry thoroughly;

It provides easier access to a shower cap from its storage place;

It can be used easily and comfortably without damage to the shower cap;

It is simple to make and inexpensive to manufacture.

Although the description above contains many specificities, these should not be construed as limiting the scope of the invention but as merely providing descriptions of some of the presently preferred embodiments of this invention. For example, the fasteners used for the suspension device could be buckled, buttoned, or hook together rather than the hook-and-loop; the suspension devices attached to the shower cap can be changed in size (made thinner or wider, longer or shorter); the suspension device can be made of a different material other than elastic such as plastic, cotton, etc.; the suspension device can be made of a different color(s) to match the shower cap; the suspension device can be connected to the shower cap in a different manner such as glued, stapled, snapped, etc; the suspension device could be used to suspend other items such as hats, umbrellas, mittens, gloves, etc., if it were made separately from the shower cap.

Thus, the scope of the invention should be determined by the appended claims and their legal equivalents rather than by the examples given.

What is claimed is:

1. A shower cap comprising:

a crown dimensioned and configured to contain the head and hair of the user;

said crown having a lower edge;

said lower edge defining an opening wherein said opening is of sufficient size to receive the head and hair of the user;

a band attached to and extending from said lower edge wherein said band has a first end and a second end; and said first end and said second end having mating attachment means so that said second end loops back towards said first end thereby forming a loop.

2. The shower cap according to claim 1 wherein said attachment means comprise hook and loop type fasteners and wherein said band is made of an elastic material.

3. The shower cap according to claim 1 wherein said attachment means comprise snap buttons and wherein said band is made of an elastic material.

4. The shower cap according to claim 1 wherein said attachment means comprise stitching thereby said first end of said band is permanently secured to said second end of said band.

5. A shower cap comprising:

a crown dimensioned and configured to contain the head and hair of the user;

said crown having a lower edge;

said lower edge defining an opening wherein said opening is of sufficient size to receive the head and hair of the user;

a band attached to said lower edge wherein said band has a first end and a second end; and said second end of said band and said first end of said band extend beyond and out from said lower edge, attachment means affixed to each end of the band, wherein said second end and said first end are attachable together therefore forming a loop wherein said loop may be used to suspend said shower cap.

6. The shower cap according to claim 5 wherein said attachment means comprise hook and loop type fasteners attached at said first end of said band and at said second end of said band whereby when said hook and loop type fasteners are attached together said loop is formed.

7. The shower cap according to claim 5 wherein said attachment means comprise snap buttons attached at said first end of said band and at said second end of said band whereby when said snap buttons are attached together said loop is formed.

* * * * *